US005401034A

United States Patent [19]

Mallinger

[11] Patent Number: 5,401,034

[45] Date of Patent: Mar. 28, 1995

[54] BALL GAME TRAINING DEVICE

[76] Inventor: David P. Mallinger, 3 Buckingham Close, Groby, Leicester LE6 0YX, England

[21] Appl. No.: 198,472

[22] Filed: Feb. 18, 1994

Related U.S. Application Data

[63] Continuation-in-part of Ser. No. 970,180, Nov. 2, 1992, abandoned.

[51] Int. Cl.[6] ..... A63B 43/02; A63B 69/00

[52] U.S. Cl. ..... 273/414; 273/58 C

[58] Field of Search ..... 273/413, 414, 411, 57.2, 273/58 C; 119/796

[56] References Cited

U.S. PATENT DOCUMENTS

| | | | |
|---|---|---|---|
| 3,498,613 | 3/1970 | Dreyer | 273/413 |
| 3,693,596 | 9/1972 | Croce et al. | 119/796 |
| 4,145,046 | 3/1979 | Jones | 273/411 |
| 4,147,353 | 4/1979 | Moore | 273/413 |
| 4,278,257 | 7/1981 | Garcia et al. | 273/411 |
| 4,526,374 | 7/1985 | Ban | 273/144 |
| 4,601,474 | 7/1986 | Lew et al. | 273/58 C X |
| 4,753,442 | 6/1988 | Bland | 273/414 |
| 5,083,797 | 1/1992 | Vartwa et al. | 273/414 |

FOREIGN PATENT DOCUMENTS

| | | | |
|---|---|---|---|
| 2105389 | 4/1972 | France | 273/411 |
| 392412 | 5/1933 | United Kingdom . | |

*Primary Examiner*—William H. Grieb
*Attorney, Agent, or Firm*—Frijouf, Rust & Pyle

[57] ABSTRACT

A ball game recreational or training device comprises a cartridge (1) adapted to be held in a user's hand. The cartridge (1) houses a reel (21) on which a tether (3) such as a braided rope is wound. The free end of the tether (3) emerges from the cartridge (1) and a ball (5), e.g. a soccer ball, is secured to it. A force applied to the ball (5), e.g. by kicking, causes the tether (3) to unwind from the reel (21). The reel (21) is spring-loaded for automatic rewinding of the tether (3). The cartridge (1) is also provided with a thumb-actuatable button (7) by which the flight of the ball (5) away from the user may be arrested.

16 Claims, 2 Drawing Sheets

BALL GAME TRAINING DEVICE

CROSS-REFERENCE TO RELATED APPLICATIONS

This is a continuation-in-part of United States patent application Ser. No. 07/970,180, filed Nov. 2, 1992, now abandoned.

BACKGROUND OF THE INVENTION

1. Field of the Invention

This invention relates to a ball game recreational and training device, in particular to such a device for use as a training aid for soccer.

2. Description of the Prior Art

Training devices for soccer or other ball games, in which the ball is held captive on a tether secured to, or held by, the user, are known. Such devices eliminate the need for the user to retrieve the ball after it has been kicked away.

In one recent disclosure of such a device (U.S. Pat. No. 5,083,797), the ball is held in a net to which is attached one end of an inelastic cord. The cord has a loop at the other end which is held by the user. The length of the cord can be adjusted in dependence on the particular exercise being performed. A disadvantage of this known training device is that the tether is relatively short and the ball is therefore retained in very close proximity to the user. Whilst this is acceptable for many exercises, in other cases, e.g. where the ball is struck with considerably force, it is undesirable or impractical.

U.S. Pat. No. 4,145,046 discloses a device in which a solid, rubber-like ball is tethered to a hand-held reel by a flexible line. A ratchet and pawl mechanism permits the line to unwind when a force is applied to the ball. The pawl is biased into engagement with the ratchet in such a manner as to prevent rewinding of the line. This device does not provide any effective means of arresting the flight of the ball. Also, the user must release the pawl in order to bring about rewinding of the line. A further disadvantage is that the ball is not a real soccer ball and therefore may not behave in a realistic manner.

In another known device, disclosed in French Patent No. 2,105,789, the ball is again held in a net to which is attached one end of a cord. The cord is wound on a reel housed in a unit held by the user. When the ball is kicked by the user, the cord unwinds from the reel. Again, there is no provision for automatic rewinding of the cord. To rewind the cord, and hence retrieve the ball, the user must press a button on the unit. This brings an electrical motor into engagement with the reel and simultaneously completes an electrical circuit which energizes the motor. Engagement of the motor with the reel is by means of a drive plate on the end of the motor shaft. The plate is pressed against the side of the reel and engages the reel frictionally.

Furthermore, such a device is not effective in arresting movement of the ball away from the user. The device is thus not suitable for use in a confined space. Also, the device is relatively complex and requires the provision of an electrical battery.

BRIEF SUMMARY OF THE INVENTION

There has now been devised a ball game recreational and training device which overcomes or substantially mitigates the above-mentioned disadvantages.

According to the invention, there is provided a ball game recreational or training device comprising

- a housing adapted to be held in a user's hand and having an opening,
- a reel mounted for rotation within said housing,
- a tether wound on said reel, a free end of said tether passing through said opening in said housing,
- a ball secured to said free end of said tether, externally of said housing, such that said tether may be dispensed from said reel by the application of force to said ball, and
- a detent pivotally mounted within said housing, said detent being moveable from a first position in which said detent is clear of said reel to a second position in which said detent engages said reel thereby to arrest dispensing of said tether from said reel,
- wherein said reel is spring-loaded for automatic rewinding of said tether, and said wherein there are provided resilient means biassing said detent to the first position.

The device according to the invention is advantageous primarily in that its versatility enables it to be used in a greater variety of exercises than known such devices. Since the detent is biased to the first position, in which it is clear of the reel, the ball may be kicked away, and is retrieved, without the need for the user to perform any separate action such as pressing a button. Nonetheless, the detent may be used to arrest the flight of the ball as it is kicked or otherwise :propelled away from the user, and the device may therefore be used safely within a confined space. Where space permits, the possibility of extending the tether to relatively long distances, e.g. of several meters, may enable some exercises to be more realistic, e.g. heading, volleying and ball receiving exercises, the flight of the ball being more similar to that of a free ball.

The detent is preferably operably connected to a button actuatable by, for example, the thumb of the user's hand. In use, with the button released, the ball may be kicked away, thereby causing the tether to unwind. The ball then travels a distance dependent upon the force applied to it, and returns under the influence of the spring-loaded reel. Alternatively, e.g. if he is using the device in a confined space, the user may arrest the travel of the ball by depressing the button and thereby moving the detent to the second position. The ball then returns under its own momentum, or under the influence of the spring-loaded reel if the button is released, or is recovered by the user tugging on the tether, slack in the tether being taken up automatically by the spring-loaded reel after the button is released.

The resilient means biassing the detent to the first position is preferably a resilient spring.

Engagement of the detent with the reel in the second position is preferably by cooperation of the detent with suitable formations provided on the reel.

It is preferred that the detent should be moveable to a third, locking position in which rotation of the reel in either sense is prevented. This permits exercises to be performed in which the length of dispensed tether between the reel and the ball is fixed. For some exercises it may be desirable to utilize a lengthy tether, whilst for others a short tether is appropriate.

The housing is preferably of moulded plastics, and preferably has an integral handle.

The tether itself may be of any material of suitable strength and flexibility. One example is a braided rope of suitable synthetic material, e.g. nylon.

Suitable reel and tether assemblies may be similar to those utilized in extending dog leashes.

The means for securing the tether to the ball may include a net to which the end of the tether is fixed, the net being of a suitable size and mesh to hold the ball captive.

To prevent twisting of the tether, it may include a swivel close to the ball. The swivel may be of conventional form and permits rotation of the ball about the axis of the tether, without twisting of the tether. The swivel may be positioned about 1 meter from the end of the tether and may also serve as a stop, preventing complete rewinding of the tether onto the reel.

Although of particular utility in conjunction with a soccer ball, the device of the invention may also be used with certain other game balls.

DETAILED DESCRIPTION OF PREFERRED EMBODIMENT

Figure 1:
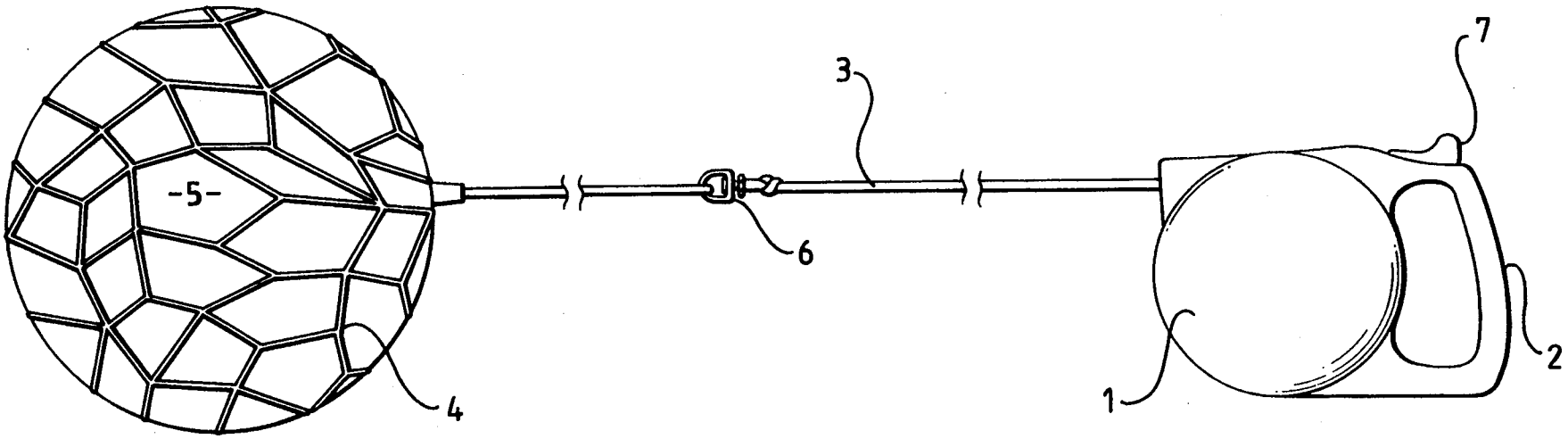
FIG. 1 is a side elevation of a ball game recreational and training device according to the invention.

Referring first to FIG. 1, a ball game recreational and training device comprises a moulded plastics cartridge 1 with an integral handle 2. The cartridge 1 contains a spring-loaded reel (see FIG. 2) oil which is wound a braided nylon cord 3. The cord 3 extends through an opening in the cartridge 1 and its free end is secured to a net 4 which closely surrounds a soccer ball 5.

The cartridge 1 also contains a stop mechanism (described below) operable by a thumb-actuatable button 7 which protrudes through an aperture in the cartridge 1. When the button 7 is depressed, withdrawal of the cord 3 from the cartridge 1 is prevented. When the button 7 is released, the cord 3 may be withdrawn from the cartridge 1. In the absence of any withdrawing force, the cord 3 is rewound by the spring-loaded rewinding action of the reel.

About 1 meter from the ball 5, the cord 3 is interrupted by a swivel 6. The swivel 6 is of conventional form and comprises two substantially D-shaped steel loops, one of which is provided with an axle on which the other is rotatably mounted. The swivel 6 permits the ball 5 to twist about the axis of the cord 3 without causing twisting of the cord 3 itself.

Figure 2:
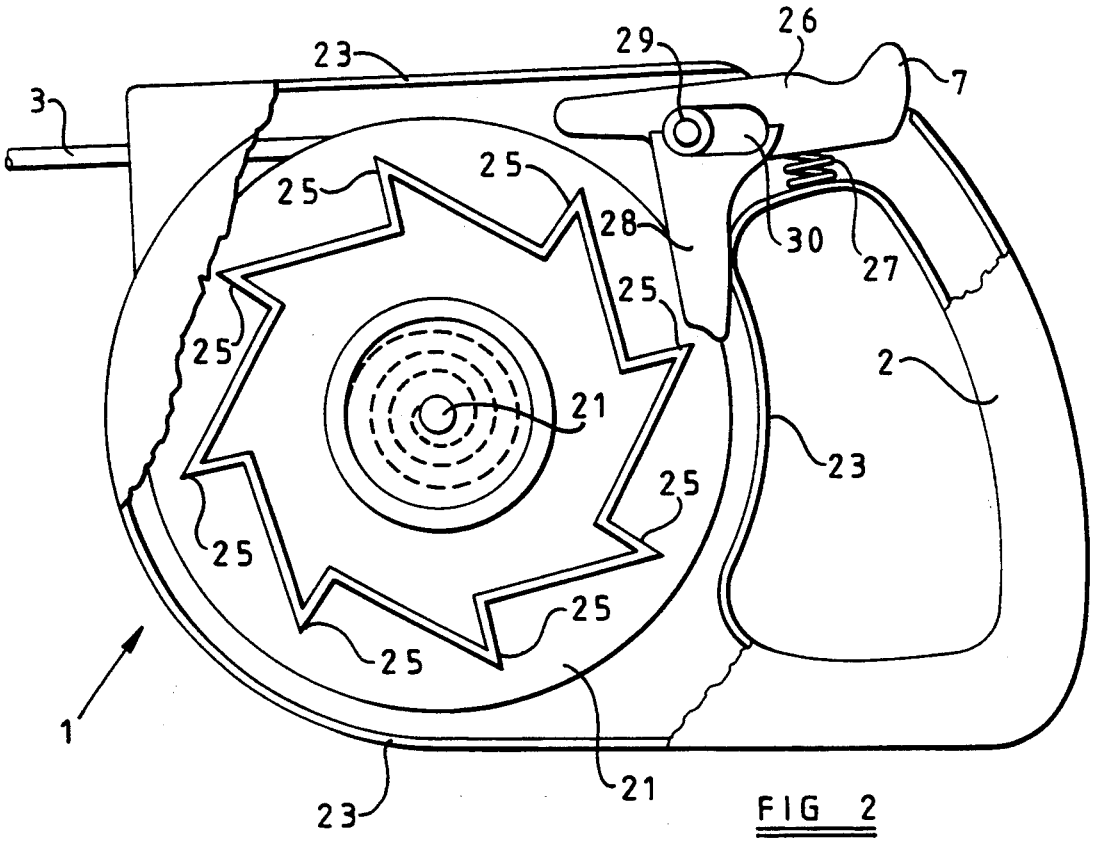
FIG. 2 is a side elevation, partly cut away, of a handle cartridge forming part of the recreational and training device of FIG. 1, in a cord dispensing position.

Referring now to FIG. 2, the cartridge comprises a pair of moulded plastics housing members having interfitting male and female formations around their edges. In FIG. 2, the housing member with male formations is shown cut away to reveal the female formations 23 on the other housing member.

The cartridge 1 houses a reel 21 on which the cord 3 is wound. The reel 21 is mounted on a spindle 24 and is biased by a helically coiled ribbon spring (shown schematically by a broken line in FIG. 2) such that, unless prevented by the stop means in the manner described below, the cord 3 is automatically rewound. The ribbon spring is housed in a hollow, radially inner, portion of the reel 21., one end of the spring being held in a transverse slot in the spindle 24. The side faces of the reel 21 are provided with upstanding formations which define a series of equi-angularly spaced stops 25.

The thumb actuatable button 7 is formed on a pivotally mounted stop member 26. The stop member 26 is mounted on a shaft 29 which is received in an elongated bore 30 in the stop member 26. The stop member 26 is provided with a pair of downwardly depending limbs 28 (only one of which is visible in the drawings) which extend downwards on either side of the reel 21. The button 7 is biased upwards by a compression spring 27 into the position shown in FIG. 2. In this position, the downwardly depending limbs 28 are clear of the stops 25 and hence the cord 3 may be dispensed against the action of the ribbon spring (e.g. by the user kicking the ball 5). In this position, after the ball 5 is kicked away, the cord 3 is automatically rewound under the influence of the ribbon spring.

Thus, with the button 7 in its normal, rest position the user may kick the ball 5 away, the travel of the ball 5 being limited only by the effect of the ribbon spring or by the length of the cord 3. After reaching the limit of its travel, the ball 5 returns automatically to the user.

Figure 3:
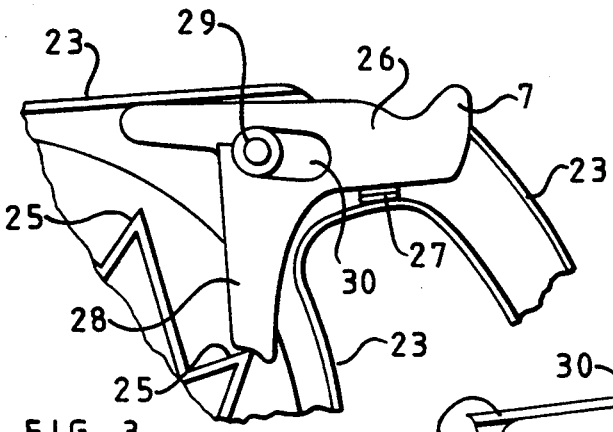
FIG. 3 is a partial view of the handle cartridge of FIG. 2, in a cord arresting position.

If the user is using the device in a confined space, or if he wishes to increase the speed of repetition of the exercises he is performing, the user may arrest the flight of the ball 5 by depressing the button 7 against the action of the compression spring 27. When this is done, the stop member 26 pivots about the shaft 29 into the position shown in FIG. 3. In this position the downwardly depending limbs 28 engage the stops 25 formed on the reel 21 and prevent further dispensing of the cord 3. Release of the button 7 returns the stop member 26 to its original position, shown in FIG. 2, and permits rewinding of the cord 3.

Figure 4:
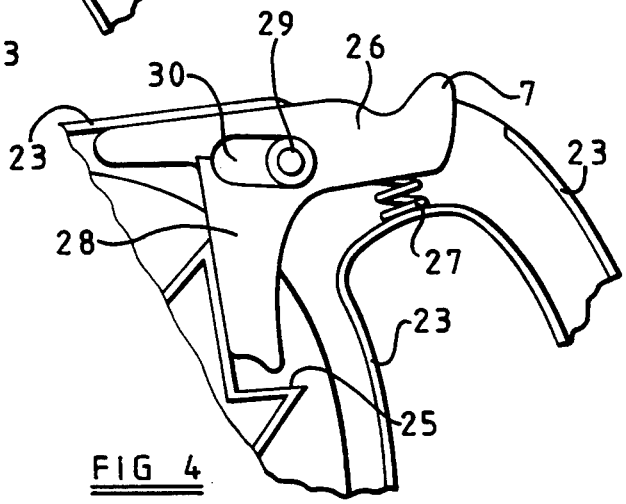
FIG. 4 is a partial view of the handle cartridge of FIG. 2, in a locked position in which cord may be neither dispensed nor rewound.

Finally, it may be desired to perform an exercise in which the length of dispensed cord is held constant. This can be achieved either by continued pressure on the button 7 to hold it in the FIG. 3 position. More conveniently, however, the button is pressed downwardly and forwardly to the position shown in FIG. 4. In this position, rotation of the reel 21 in either sense is prevented by the downwardly depending limbs 28.

In use, the user holds the handle 2 in his hand and may perform a great variety of tricks or training exercises. For example, he may, with the button 7 released, kick the ball 5. When the ball 5 reaches the end of its flight, it returns under the influence of the spring-loaded reel 21. Alternatively, the user may limit the travel of the ball 5 by depressing the button 7, preventing further withdrawal of the cord 3 from the cartridge 1 and arresting the flight of the ball 5. The ball 5 may then return under its own momentum to the user. Alternatively, holding the button 7 down, the user tugs on the cord 3 by jerking the hand holding the cartridge 1 backwards. This causes the ball 5 to return, any slack cord 3 being taken up automatically upon release of the button 7.

To practice volleys or headers, the user may depress the button 7 to hold the length of the cord 3 fixed, and flick the ball 5 into the air. He then kicks or heads the ball 5, simultaneously releasing the button 7. The ball is then retrieved as described above. Alternatively, the user may withdraw a desired length of cord 3 from the cartridge 1 and then press the button 7 downwardly and forwardly, into the position shown in FIG. 4. In this position, the length of the tether dispensed from the cartridge is fixed.

I claim:

1. A training device for a ball affixed to a rope, comprising;

a cartridge with a handle adapted to be held in a hand of a user;

a reel rotatably housed within said cartridge;

securing means for affixing the rope to said reel;

a spring disposed between said cartridge and said reel for winding the rope on said reel to automatically retrieve the ball;

a plurality of stops extending from and spaced about said reel;

a stop member pivotably mounted about a shaft within said cartridge;

an actuator button extending from said stop with said actuator button being located external to said cartridge;

bias means for biasing said actuator button into a first position whereat the ball may be propelled by the user thereby unwinding the rope from said reel until the rope is rewound by said spring on said reel to automatically retrieve the ball;

said actuator button being moveable by the user into a second position for moving said stop member into engagement with one of said plurality of stops extending from said reel to prevent rotation of said reel; and said actuator button enabling the ball to be first propelled by the user and for the user to inhibit further rotation of said reel upon moving said actuator button into said second position for limiting the area of movement of the ball.

2. A device as claimed in claim 1, wherein said reel is enclosed in a cartridge which has an integral handle.

3. A device as claimed in claim 1, wherein said reel is enclosed in a cartridge which has an integral handle; and said actuator button being disposed proximate to said handle enabling a user to grasp said handle and to actuate said actuator button with a thumb of the user.

4. A device as claimed in claim 1, wherein said plurality of stops are uniformly angularly spaced about said reel.

5. A device as claimed in claim 1, wherein said actuator button is moveable by the user into a third position for locking said stop member into engagement with one of said plurality of stops extending from said reel to inhibit the winding and unwinding of said reel for establishing a predetermined length of the rope suitable for the area of movement of the ball.

6. A device as claimed in claim 1, wherein the ball is disposed within a net of a suitable size and mesh to hold the ball captive within said net; and the rope being secured to said net.

7. A device as claimed in claim 1, including a swivel interposed in said rope proximate to the ball for inhibiting twisting of the rope.

8. A device as claimed in claim 1, wherein said rope is a braided rope of synthetic material.

9. A device as claimed in claim 1, wherein said rope is a braided rope of nylon material.

10. A device as claimed in claim 1, wherein the ball is a soccer ball.

11. A soccer training device for a soccer ball affixed to a rope, comprising;

a cartridge with a handle adapted to be held in a hand of a user;

a reel rotatably housed within said cartridge;

means for securing the rope to said reel;

a spring disposed between said cartridge and said reel for winding the rope on said reel to automatically retrieve the soccer ball;

a plurality of stops extending from and spaced about said reel;

a stop member pivotably mounted about a shaft within said cartridge;

an actuator button extending from said stop with said actuator button being located external to said cartridge;

bias means for biasing said actuator button into a first position whereat the soccer ball may be propelled by the user thereby unwinding the rope from said reel until the rope is rewound by said spring on said reel to automatically retrieve the soccer ball;

said actuator button being moveable by the user into a second position for moving said stop member into engagement with one of said plurality of stops extending from said reel to prevent rotation of said reel;

said actuator button enabling the soccer ball to be first propelled by the user and for the user to inhibit further rotation of said reel upon moving said actuator button into said second position for limiting the area of movement of the soccer ball and for enabling the rope to be rewound by said spring on said reel to automatically retrieve the soccer ball upon the user releasing said actuator button; and said actuator button being moveable by the user into a third position for locking said stop member into engagement with one of said plurality of stops extending from said reel to inhibit the winding and unwinding of said reel for establishing a predetermined length of the rope suitable for the area of movement of the soccer ball.

12. A device as claimed in claim 11, wherein said reel is enclosed in a cartridge which has an integral handle.

13. A device as claimed in claim 11, wherein said reel is enclosed in a cartridge which has an integral handle; and said actuator button being disposed proximate to said handle enabling a user to grasp said handle and to actuate said actuator button with a thumb of the user.

14. A device as claimed in claim 11, wherein said plurality of stops are uniformly angularly spaced about said reel.

15. A device as claimed in claim 11, wherein the ball is disposed within a net of a suitable size and mesh to hold the ball captive within said net; and the rope being secured to said net.

16. A device as claimed in claim 11, including a swivel interposed in said rope proximate to the ball for inhibiting twisting of the rope.

* * * * *